United States Patent [19]

Mess

[11] 4,074,499

[45] Feb. 21, 1978

[54] FILLER PLUG FOR COIL INSERT IN CONCRETE SLAB OR PANEL

[75] Inventor: Richard C. Mess, Washington Township, Montgomery County, Ohio

[73] Assignee: The Dayton Sure-Grip & Shore Company, Miamisburg, Ohio

[21] Appl. No.: 761,263

[22] Filed: Jan. 21, 1977

Related U.S. Application Data

[63] Continuation-in-part of Ser. No. 648,521, Jan. 12, 1976, abandoned.

[51] Int. Cl.[2] ..... E04B 1/38

[52] U.S. Cl. ..... 52/705

[58] Field of Search ..... 52/705, 125, 127, 699, 52/700, 701, 98, 22; 246/302, 362, 355, 356; 249/213, 215

[56] References Cited

U.S. PATENT DOCUMENTS

| | | | |
|---|---|---|---|
| 1,945,707 | 2/1934 | Sharp | 52/221 X |
| 2,880,608 | 4/1959 | Boll et al. | 52/705 X |
| 3,216,171 | 11/1965 | Jenkins | 52/705 X |
| 3,590,538 | 7/1971 | Holt | 52/705 X |
| 3,742,661 | 7/1973 | Tye | 52/705 X |

*Primary Examiner*—Ernest R. Purser
*Assistant Examiner*—Carl D. Friedman
*Attorney, Agent, or Firm*—Biebel, French & Nauman

[57] ABSTRACT

A plug for temporary use with a coil insert in a concrete product such as a slab or panel comprises a hollow elastomeric body having the outer surface thereof proportioned and threaded for firm matching engagement within the threaded interior surface of the coil with which it is to be used upon predetermined radial contraction and axial elongation from the unstressed condition thereof. The plug is open at one end and closed at the other end, with a stem of smaller diameter projecting from its closed end. The plug is assembled in the coil by means of a rod forced internally against its closed end, causing the plug body to elongate and contract radially sufficiently to be moved axially into place within the coil, and it is removed from the coil by using its stem as a handle for applying pulling force causing sufficient elongation and radial contraction of the plug body for withdrawal from the coil. The outer surface of the elastomeric body may be threaded only adjacent its ends with the intervening surface substantially smooth.

9 Claims, 8 Drawing Figures

FIG-1
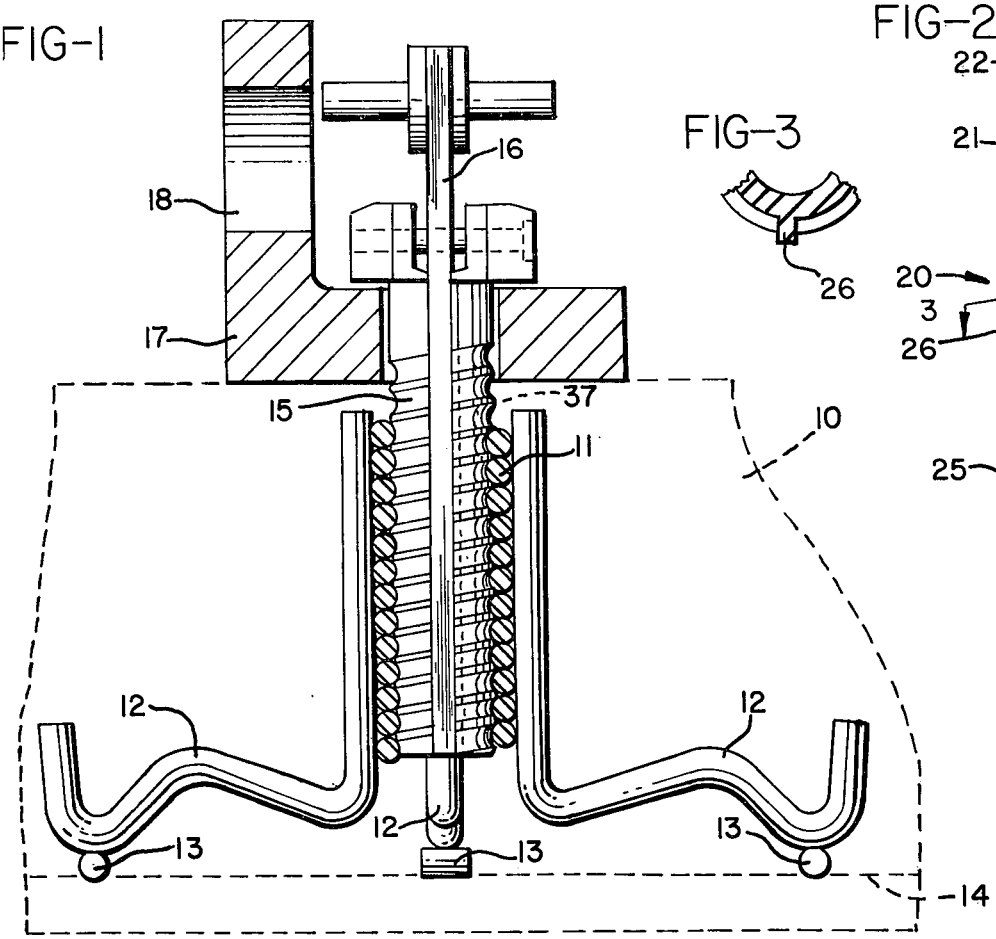
FIG-2
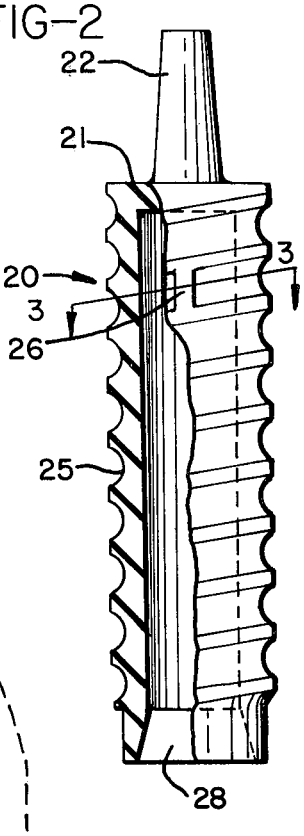
FIG-3
FIG-4
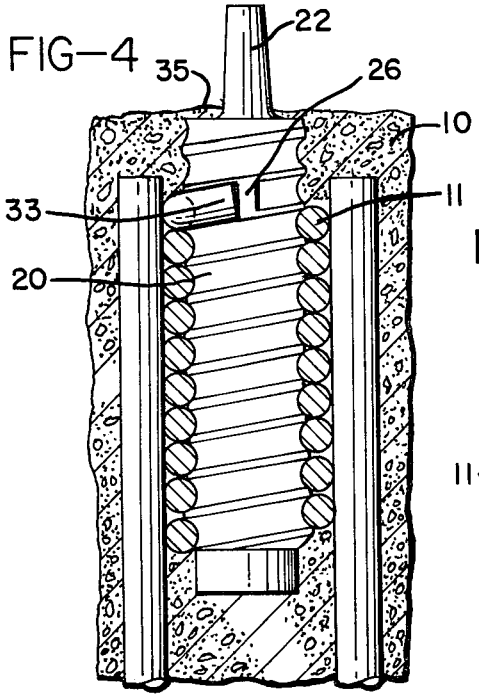
FIG-5
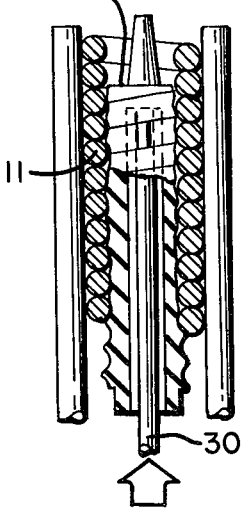
FIG-6
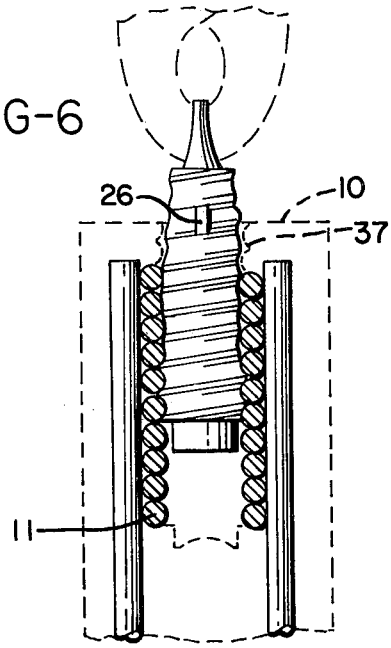

FILLER PLUG FOR COIL INSERT IN CONCRETE SLAB OR PANEL

CROSS REFERENCE TO RELATED PATENT APPLICATION

The present application is a continuation-in-part of U.S. patent application Ser. No. 648,521, filed Jan. 12, 1976, abandoned.

BACKGROUND OF THE INVENTION

This invention relates to the handling of cast concrete slabs, and more particularly, to novel development in connection with the use of a coil insert or nut member for embedding in a cast concrete slab or panel to receive a bolt used to attach detachable hoisting means for lifting the slab.

In recent years, a form of building construction referred to as the tilt-up slab method has come into rather wide usage. In tilt-up slab building, large concrete slabs are formed either on the floor of the building or on a level ground surface. The concrete slabs are then lifted to a vertical position and interconnected to form the walls of the building.

The attachments to the slabs which are used for lifting them must be removable after the slabs have been lifted into place to facilitate the provision of a smooth surface on the walls of the building. Generally, the lifting attachments, such as a lifting ring and bolt, are installed and removed at the building site, and therefore they are designed to be easily and rapidly installed and removed in order to save maximum time.

The insert into which the bolt is threaded is normally permanently embedded in the slab or panel. When the lifting attachments are removed from the slab, a hole where the insert is located remains in the slab and must be filled to provide a smooth outer surface. The insert should therefore be small enough to be easily and readily concealed after the slab has been installed, and yet should be able to sustain the forces of lifting heavy slabs or panels. Also, it should not interfere with rapid attaching and detaching of the lifting means.

The art has for many years used bolts of conventional types having relatively course threads, including nut headed bolts for use with a lifting device in which a hoist can be attached, and also eye bolts which do not require separate lifting rings. A more recent development in the art is a split bolt such as shown in Strong U.S. Pat. No. 3,456,547 or Grayson U.S.Pat. No. 3,922,946 which can be rapidly inserted without threaded into an insert in a slab and then tightened in place by only a partial revolution.

Such a split bolt comprises a pair of separate longitudinal segments such as would be formed if a conventional bolt is split along its axis and then has a portion removed along the axis from each segment so that when the two segments are placed together, they can be inserted axially into an insert sized for threaded reception of the entire bolt. An axially movable key member or wedge is used to replace the removed portions and thereby to spread the two segments into threaded engagement with the insert, and a partial turn of the bolt will then tighten it securely in place. The bolt is removed by withdrawing the key, thereby enabling the two segments to be brought together out of threaded engagement with the insert for axial withdrawal without rotation.

The inserts commonly used with both solid bolts and split bolts comprise a coil of a plurality of turns of heavy wire or rod stock welded to supporting leg members or the like for locating the coil in proper position in a poured concrete slab or panel, commonly by setting the foot portions of the leg members on the form on which the slab is poured. Experience has established that there is a practical minimum number of turns in a coil and threads on a coil bolt which must be in engagement to assure adequate lifting strength without causing the coil turns to separate and to release the bolt.

A number of alternative means have been used in the art for this space-establishing purpose, including plugs of various kinds which serve to prevent access of fluid concrete both to the interior of the coil and into a space immediately adjacent the inner end of the coil, and which can be burnt out or otherwise removed after the concrete is set. Among patents showing a plug of special characteristics for this purpose are Boll et al. U.S. Pat. No. 2,880,608, Jenkins U.S. Pat. No. 3,216,171, Holt U.S. Pat. No. 3,590,538 and Tye U.S. Pat. No. 3,742,661. The plugs of all of such patents, however, offer certain disadvantages from the standpoint of both cost and simplicity of use, as now briefly summarized.

Boll et al. discloses the use of a filler plug described as composed of sponge rubber or some easily compressed rubber or elastic material allowing the plug to be easily inserted and to retain itself in place yet to be easily subsequently removable. Boll, however, does not teach how to insert or remove the plug, and apparently it would have to be crammed into place and subsequently dug out piecemeal. Each of the other three patents shows a two-part plug which must be separately threaded or otherwise fitted in place at opposite ends of the coil prior to installation, with the outer plug being removed after the concrete has set but with the inner plug remaining in place for partial destruction by the coil bolt as it is threaded into the insert.

In U.S. Pat. No. 3,889,916, issued June 17, 1975 to Ilukowicz, a solid plastic protective plug for an insert is disclosed. This insert is configured only for use with edge inserts which are positioned adjacent a mold wall and, additionally, must be threaded completely into and out of the coil. Insertion and removal of the insert is therefore time consuming.

SUMMARY OF THE INVENTION

It is the major purpose of the present invention to provide a novel construction of plug for use with coil inserts which offers significant advantages over all prior art devices for the same purpose in the way of production cost as well as ease of both assembly in the coil and removal from the coil in the slab after the concrete has set.

The plug of the invention is a hollow member of elastomeric material open at the end thereof which is innermost in the slab and with its outer end closed and provided with a projecting stem proportioned to extend at least to the outer surface of the slab. The outer surface of this plug is threaded for matching engagement with the inner surface of the coil, and the body of the plug is at least as long as the full length of the coil bolt to be received in the coil. The outer surface of the plug may be threaded along its entire length or, alternatively, may be threaded only adjacent the ends of the plug with the intervening outer surface being substantially smooth. This alternative thread configuration eliminates problems which may result in the completely threaded embodiment from thread misalignment along the intermediate portion of the plug surface.

Assembly of the plug of the invention in a coil is accomplished very easily—by inserting a rod into the plug through its open end and then forcing the closed end of the plug through the coil from its lower end. Under these conditions, the plug will elongate, and at the same time contract in cross section sufficiently to be pushed axially through the coil to the desired position in which it completely fills the coil with its threaded surface in matching engagement with the inner surface of the coil, and with the stem on its closed end projecting beyond the top of the coil.

After the slab has set, each coil insert is readily located by the projection of the stem on its plug to or above the slab surface, and the concrete immediately above the coil is chipped away sufficiently to expose the end of the plug. The plug stem is then used as a handle to pull the entire plug out of the slab. This may be easily accomplished since, as the stem is pulled, the plug elongates and at the same time contracts radially sufficiently to be pulled free of the engagement between its threaded surface and the threaded interior of the coil.

When the coil inserts are used in vertical position during casting of the slab, each plug will similarly stand vertically and will limit entry of fluid concrete into its lower end. Since the thickness of the slab is commonly in the range of only 4 to 8 inches, the hydraulic pressure head of the fluid concrete is correspondingly low, and experience has shown that it is balanced substantially by compression of the air within each plug after the concrete has not risen more than a small fraction of an inch inside the plug. Release of the plug from this concrete is facilitated if the inner end of the plug is beveled to diverge outwardly, and it may also be provided with a release coating further facilitating its ready separation from the concrete as it is pulled out of the coil. If the coil insert is used horizontally in the end of a slab, the plug of the invention can still be used but should have its open end closed by a cork or the like which will remain in the slab after the plug is removed.

BRIEF DESCRIPTION OF THE DRAWINGS

FIG. 1 is a somewhat diagrammatic view partly in section and showing a fragment of a slab with a coil insert and lifting means in position for use;

FIG. 2 is a view partly in section and partly in elevation of a removable plug in accordance with the invention;

FIG. 3 is a fragmentary section on the line 3—3 of FIG. 2;

FIG. 4 is a view similar to FIG. 1 showing the coil insert with the plug in place prior to its removal from the slab;

FIG. 5 is a somewhat diagrammatic sectional view illustrating the insertion of the plug of FIG. 2 into the coil insert prior to casting of the slab;

FIG. 6 is a view similar to FIG. 1 illustrating the removal of the plug from the coil insert within the slab;

DETAILED DESCRIPTION OF THE PREFERRED EMBODIMENTS

Figure 7:
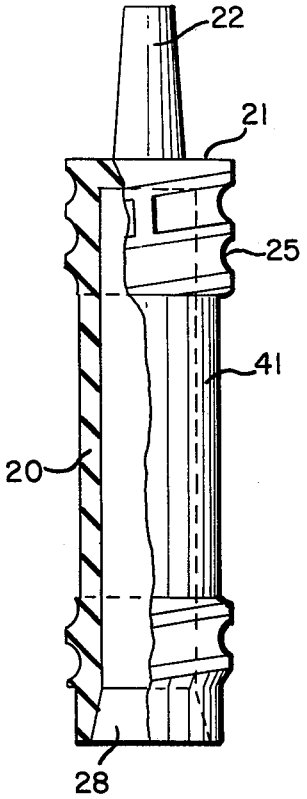
FIG. 7 is an elevational, with portions broken away and in section, of an alternative embodiment of the present invention.

In FIG. 1, the slab 10 contains a coil insert comprising a coil 11 and supporting legs 12, each of which has a foot 13 resting on the surface of the mold bottom 14. The coil 11 is formed of closely spaced turns of heavy wire or rod defining an internal screw thread surface which will accept the threads of the coil bolt 15, shown as a split bolt of the construction disclosed in Grayson U.S. Pat. No. 3,922,946 issued Dec. 2, 1975 and including a central key or wedge member 16.

The vertical portion of legs 12 are welded to the turns of coil 11 to secure the adjacent turns together and thereby to enable the coil to retain the bolt 15 against being stripped out by the lifting forces which act thereon through the lift pickup means 17, shown as a piece of angle iron to which a hoisting cable can be attached at 18, but which may be of any conventional type such as a lifting ring. Experience has established that if the coil comprises at least six turns, it will be strong enough for normal uses, with coils of larger diameter being used for slabs of greater thickness. It is important, however, that the coil engage an intermediate portion of the bolt where the threads are least subject to wear and are of essentially uniform full size, as compared with the end of the bolt which is subject to greater wear and also likely to be reduced diameter. It is necessary, therefore, that the coil interior be free of concrete and have a sufficient number of turns to engage both the intermediate portion of the bolt and the end portion below it.

In accordance with the invention, this purpose is accomplished by means of a plug 20 of elastomeric material which is hollow, open at one end, but closed at its opposite end 21 and provided at its closed end with a solid stem 22 of substantially smaller diameter. The exterior surface 25 of the plug 20 is molded with integral threads matching the interior of the coil 11 in pitch and essential dimensions such that in the substantially unstressed condition of the plug, it is slightly larger, e.g. 0.015–0.025 inch, in diameter than the threaded interior surface of the coil so that when it is inserted into the coil, its threaded surface 25 will match and firmly engage the threaded interior surface of the coil. In addition, a locator lug 26 is molded on the surface 25 in predetermined spaced relation with its upper end 21 for a purpose described below. Preferably, the open end of the plug 20 has its inner surface beveled at 28 to diverge outwardly.

Insertion of a plug 20 in a coil 11 could not be effected by threading the coil in place, both because of its larger size in unstressed condition as just described, and also because the torsional stresses resulting from an attempt to thread it forceably into the smaller interior of the coil would tend to cause further increase in its diameter. It can be inserted quickly and easily, however, by means of a rod 30 inserted through its open end and used to force its closed end 21 through the coil as illustrated in FIG. 5. Under these conditions, the plug will be forced to elongate and to contract radially sufficiently to avoid interference with the threaded interior of the surface of the coil, and the plug can be readily pushed through the coil as far as desired. The proper final position is as shown in FIG. 4, with the closed end 21 projecting sufficiently from the upper end of the coil to be substantially flush with the upper surface of the slab 10. Note also that the exposed end portion of the plug is expandable radially with respect to the portion which is confined in coil 11. The coil 11 must extend substantially as low as the lower end of the plug 20 in order to prevent the plug from being partially collapsed by the semi-fluid concrete mixture.

The locator lug 26 is used to establish the proper relation of plug 20 in coil 11. The position of lug 26 is spaced such distance away from its upper end of the plug that if this lug is substantially in engagement with the upper end 33 (FIG. 1) of the rod or wire which forms coil 11, the closed end surface of the plug will be properly spaced above the coil to be flush with the upper surface of the slab 10. The stem 22 will then project above the slab to its full length, typically one inch.

The plug 20 has the dual purpose of preventing access to the interior to the coil 11 by concrete which would contaminate the threaded interior surface of the coil, and also of providing the full necessary amount of space within the slab for reception of the coil bolt 25 in a position firmly clamping the pick up means 17 against the top of the slab. In the preferred practice, the lift insert has an overall height such that its uppermost end will be a predetermined distance, commonly ⅜ inch, below the top of the finished slab. The closed upper end of the plug 20 should accordingly be spaced sufficiently beyond the upper end of the coil 11 to be flush with the upper surface of the slab, as is accomplished by means of lug 26 as already described, and its length is determined by the size of the coil and the corresponding length of the coil bolt.

With the coil insert and plug of the relative dimensions noted above, the stem 22 of each plug 20 will extend above the surface of the slab and will be surrounded by the concrete filling the space immediately above the coil 11 and its legs 12, but since stem 22 is flexible, it will not interfere with standard screening operations, but commonly there will be a thin walled dome of concrete immediately above the plug, as shown at 35 in FIG. 4. When the concrete has set, each coil insert is readily located by the projection of its associated stem. The concrete dome 35 surrounding the stem and immediately above the plug is chipped out to expose the upper end of the plug, and the plug is then easily removed by a pulling force applied to its stem 22, as by pliers or the like indicated on dotted lines 35. As illustrated in FIG. 6, this will cause the plug to elongate and simultaneously to contract radially to a sufficient extent to be readily pulled out of the slab, leaving the coil open for reception of a coil bolt.

As already noted, when the plug of the invention is used as illustrated in the drawings, it acts with the support of the surrounding coil like an inverted cup in liquid in that compression of the air trapped in its interior will limit the extent to which the fluid concrete can enter its lower end. Having in mind that, in general, the lower end of a plug 3.75 inches long will be correspondingly less than four inches below the top of the slab, the hydraulic pressure head of the fluid concrete will be correspondingly low, and the level of the concrete will not rise above the full extent of a beveled surface 28 which is ⅜ inch in axial extent. Separation of the plug from this concrete is facilitated by the beveled surface 28, especially if the plug is coated with a release agent such as form oil. Note also that due to the radial expansion of so much of plug 20 as extends above the end 33 of coil 11, the concrete surrounding this expanded portion of the plug will be molded into an internally threaded pattern which is correspondingly slightly larger than the threaded interior surface of coil 11, and which therefore will receive a coil bolt freely and without interfering with proper engagement of the bolt within the coil, as is indicated in dotted lines at 37 in FIGS. 1 and 6.

Figure 8:
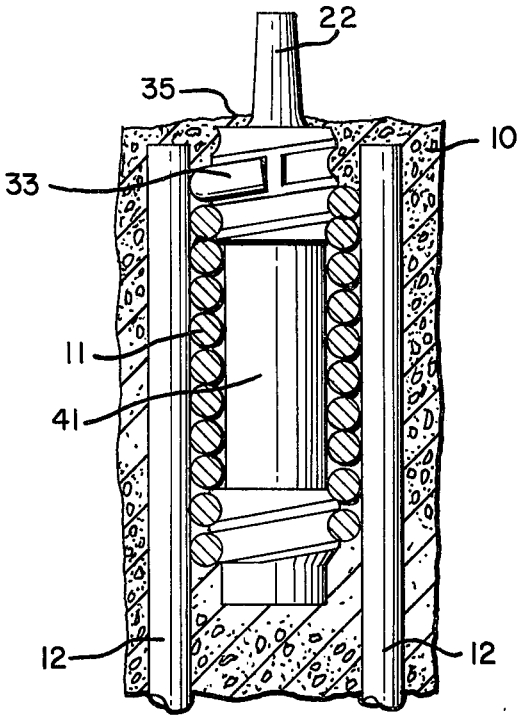
FIG. 8 is a view, similar to FIG. 4, showing a coil insert with the alternative plug in place prior to its removal from the slab.

Reference is now made to FIGS. 7 and 8 in which an alternative embodiment of the plug of the present invention is shown. As seen in FIG. 7, only the outer surface areas of the plug body 20 which are adjacent the open and closed ends of the plug are threaded. The intervening surface area 41 is substantially smooth. The plug construction shown in FIG. 7 is identical in all other respects to that shown in FIGS. 1–6. Threading only the end portions of the plug 20 does not substantially effect the ability of the plug to engage firmly the interior threaded surface of the coil, as illustrated in FIG. 8.

This form of plug construction has a significant advantage over the plug of FIGS. 1–6, however. When inserting the plug having its outer surface completely threaded into an insert coil, it occasionally happens that the axial elongation of the plug will result in engagement of the coils only at each end of the plug. The intermediate area may be stretched slightly such that the interior threaded surface of the coil 11 will not mesh properly with the exterior threaded surface of the plug. Although appearing to be properly seated in the coil, the plug, so engaged, could not be rotated in order to adjust the plug with respect to the end of the coil. By eliminating these intermediate threads on the exterior surface of the plug, the plug may be rotated slightly to bring lug 26 into proper position with respect to end 33 of coil 11.

Ordinarily, the plugs of the invention will be assembled with coil inserts for shipment as assemblies to the site of their use, in which case the plugs will be expendible after one-time use. These plugs can be reused, however, particularly by a user who recovers them after each use and assembles them with new coil inserts. Ordinarily, however, it would not be practical to recover the plugs for return to the supplier of coil inserts, because the cost of collection and shipment of used plugs would outweigh their recovery value. Even for one time use, however, the plugs of the invention offer significant practical advantages over the devices for the same purpose presently available in the art, in terms of ease of assembly and removal and of assured clear oil interiors and the necessary additional space in the slab or panel.

What is claimed is:

1. A coil insert for temporary use in combination with a coil bolt of predetermined diameter on the bottom of a mold in the fabrication of a poured concrete slab of predetermined thickness, comprising:

(a) a substantially cylindrical wire coil composed of a predetermined number of turns cooperating to define an interior threaded surface sized for threaded reception of said bolt, (b) means secured to said coil for supporting said coil in perpendicular spaced relation with the upper surface of the slab, said upper surface being parallel to said bottom surface of the mold, and (c) a plug filing said coil, said plug consisting of a hollow elastomeric body having the outer surface thereof proportioned and threaded for firm matching engagement within said interior threaded surface of said coil upon predetermined radial compression and axial expansion from the substantially unstressed condition of said elastomeric body, said plug having an unstressed diameter greater than said predetermined diameter of said coil bolt, said plug being open at the lower end thereof and closed at the upper end thereof, and stem means, attached to said upper end of said plug, of sufficient strength for applying a pulling force to said plug causing sufficient elongation and radial contraction thereof for withdrawal from said coil and the slab after the slab has set to expose said threaded coil interior for reception of said bolt, said stem means being of a diameter less than said elastomeric body and proportioned to extend from said closed plug end beyond said slab surface.

2. A coil insert as defined in claim 1 wherein the inner surface of said plug adjacent said open end thereof is tapered outwardly to facilitate release thereof from whatever concrete enters said open end.

3. A coil insert as defined in claim 1 wherein said means secured to said coil for supporting said coil comprises legs proportioned to support said coil vertically with said stem extending substantially above the upper surface of the slab.

4. The coil insert of claim 1 in which said outer surface of said elastomeric body is threaded only adjacent its ends and in which the intervening outer surface is substantially smooth, such that the threaded end portions firmly engage said interior threaded surface of said coil.

5. A coil insert as defined in claim 4 further comprising a radially extending lug portion on said outer surface of said plug and spaced a predetermined distance from said closed end thereof such that upon engagement of said lug portion with the upper end of the wire forming said coil, said closed plug end will extend above said coil into flush relation with the upper surface of the slab.

6. A plug for temporary use with a concrete product insert, including a coil defining an interior threaded surface of predetermined dimensions for receiving a bolt of predetermined dimensions, comprising:

(a) a hollow elastomeric body having the outer surface thereof proportioned and threaded for firm matching engagement within said threaded coil interior surface upon predetermined radial compression and axial expansion from the substantially unstressed condition of said elastomeric body, the unstressed diameter of said elastomeric body being greater than the diameter of said bolt, said plug being open at one end thereof and closed at the other end thereof, and (b) handle means, projecting from said closed end of said body, sufficiently sized for applying pulling force to said plug causing sufficient elongation and radial contraction thereof for withdrawal from said coil to expose said threaded coil interior surface for reception of a bolt, said handle means including a stem of a diameter less than that of said body.

7. A plug as defined in claim 6 wherein the inner surface of said plug adjacent said open end thereof is tapered outwardly to facilitate release thereof from concrete which may enter said open end.

8. A plug as defined in claim 6 further comprising a radially extending lug portion on said outer surface of said body and spaced a predetermined distance from said closed end thereof such that upon engagement of said lug portion with the upper end of the wire forming said coil, said closed plug end will extend a predetermined distance above said coil.

9. The plug of claim 6 in which said outer surface of said body is threaded only adjacent its end and in which the intervening outer surface is substantially smooth, such that the threaded end portions firmly engage said interior threaded surface of said coil.

* * * * *

UNITED STATES PATENT AND TRADEMARK OFFICE

CERTIFICATE OF CORRECTION

PATENT NO. : 4,074,499

DATED : February 21, 1978

INVENTOR(S) : Richard C. Mess

It is certified that error appears in the above-identified patent and that said Letters Patent are hereby corrected as shown below:

column 6, line 48 "oil" should read--coil column 8, line 36 "end" should read--ends Signed and Sealed this

*Fifth* Day of *September 1978*

[SEAL]

*Attest:*

RUTH C. MASON
*Attesting Officer*

DONALD W. BANNER
*Commissioner of Patents and Trademarks*